United States Patent [19]

Harris et al.

[11] 4,333,537

[45] Jun. 8, 1982

[54] IMPACT DRILLING TOOL HAVING IMPROVED VALVING

[76] Inventors: Jesse W. Harris, 527 Sonnet Dr., San Antonio, Tex. 78216; Louis L. Lutich, 107 E. Turbo, San Antonia, Tex. 78216

[21] Appl. No.: 201,579

[22] Filed: Oct. 28, 1980

Related U.S. Application Data

[63] Continuation of Ser. No. 963,221, Nov. 24, 1978, abandoned.

[51] Int. Cl.[3] ..... B25D 9/12; F01L 21/02

[52] U.S. Cl. ..... 173/17; 173/78; 173/80; 91/234

[58] Field of Search ..... 173/17, 73, 78, 80, 173/136; 91/234

[56] References Cited

U.S. PATENT DOCUMENTS

| | | | |
|---|---|---|---|
| 2,887,989 | 5/1959 | Dulaney | 173/73 X |
| 3,040,710 | 6/1962 | Wilder | 173/78 X |
| 3,896,886 | 7/1975 | Roscoe, Jr. | 173/804 X |
| 3,964,551 | 6/1976 | Bassinger | 173/78 X |
| 4,015,662 | 4/1977 | Cochran | 173/73 X |
| 4,054,180 | 10/1977 | Bassinger | 173/73 X |
| 4,209,070 | 6/1980 | Sudnishnikov et al. | 173/78 |
| 4,248,133 | 2/1981 | Petukhov et al. | 91/234 X |

*Primary Examiner*—Wm. Carter Reynolds
*Attorney, Agent, or Firm*—Gunn, Lee & Jackson

[57] ABSTRACT

The device described contains a pneumatically operated hammer, a feeder controlling the flow of pneumatic fluid, an anvil which is struck repeatedly by the hammer, a drill bit attached to or integral with the lower end of the anvil, and an outer casing. The device is typically used as a down hole tool in rotary drilling operations and normally utilizes pressurized air as its pneumatic fluid. The pneumatic fluid first lifts the hammer above the anvil and second pushes the hammer downward to impact against the anvil in a striking movement. Simultaneous with striking, the pneumatic fluid above the hammer is expelled through an exhauster retained in the anvil and out through the drill bit where it is utilized to transport the cuttings from the hole being drilled. The feeder operates in conjunction with the hammer to control pressurization above and below the hammer, while exhaust above the hammer is controlled by the lower end of said feeder tube.

4 Claims, 9 Drawing Figures

IMPACT DRILLING TOOL HAVING IMPROVED VALVING

This is a continuation, of application Ser. No. 963,221 filed Nov. 24, 1978 now abandoned.

BACKGROUND OF THE INVENTION

This invention relates to pneumatically operated impact drilling tools for rotary drilling having an improved system of valving.

There are currently many pneumatic impact drilling tools used in the field. A typical such device is disclosed in U.S. Pat. No. 3,964,551 which patent is hereby incorporated by reference.

The importance of simplicity and durability of construction in a pneumatic impact drilling tool cannot be overemphasized. The expenses involved in maintaining drilling rigs, paying skilled crews, and other time-related expenses, make it mandatory that "down-time" be held to an absolute minimum. A second essential consideration in drilling tool design is drilling rate (feet of hole drilled per unit time). This is basically related to the force of each individual hammer impact, and the frequency with which they occur.

Another prospect for time savings lies in the area of maintenance procedures; tool design should eliminate maintenance wherever possible. Required procedures, such as changing worn out drilling bits, need to be simple and fast.

Manufacturing cost is also important to a designer of down hole drilling tools, in that use of exotic materials and/or manufacturing procedures might price an otherwise satisfactory tool out of the market.

There is a constant need in the impact drilling industry for improvement in any or all of the aforementioned areas (reliability, drilling rate, maintenance, cost). Significant contributions in one or more will improve the performance of the industry and help in the economic utilization of our natural resources.

BRIEF DESCRIPTION OF THE PRIOR ART

In the incorporated reference, the prior art was discussed in great detail. Therefore, the present description of the prior art will be limited to that not covered in the incorporated reference.

The chief objective in pneumatic impact drilling tools is to provide high intensity impacts upon the drill bit while maximizing the frequency of such impacts. Normally, a hammer and anvil type of arrangement is used, the anvil being connected to the drill bit and the hammer being first lifted upward and then pushed downward by a pressurized fluid. Means for increasing impact against the drill bit include increasing the upper surface area of the hammer so that the pressurized fluid acts against more area and/or increasing the effective stroke length. This must be done within the cross-sectional area limited by the size of hole being drilled.

An example of such a pneumatically operated drill bit is shown in the incorporated U.S. Pat. No. 3,964,551. The device disclosed therein has a central feeder element around which a reciprocating hammer is located. The hammer also serves as a slidable valve means to close passages from the feeder element. This valving action controls the pressurized fluid for pressurization above the hammer, pressurization below the hammer, and exhaust from above the hammer. Exhaust from below the hammer is controlled by a slidable valve means consisting of the hammer slidably receiving an exhauster located in the anvil into a center bore of the hammer.

The feeder element of the device disclosed in U.S. Pat. No. 3,964,551 extends from a point above the hammer down to a point just above the anvil. This is necessary to accommodate separate passages within the feeder element for valving. Because the feeder element is extremely long and has thin cross-sectional areas, stresses which are created within the feeder element during the impact drilling operation may eventually cause metal fatigue and failure of the feeder element. The feeder element of the incorporated reference is expensive to manufacture because the tolerances for such a feeder element are very precise, and also because of the complexity of the many different cuts and bores therethrough.

A major problem with any type of "downhole" tool is that of limited space. The device must be capable of performing within the confines of the internal radius of the casing within which the device is enclosed. In U.S. Pat. No. 3,964,551, the feeder element must be wide enough to accommodate at least two longitudinal bores within the feeder element, one for pressurization and one for exhaust. Further, it must be sturdy enough to withstand the stresses caused in part by the length of the feeder element as discussed above. The large diameter thus required for the feeder element reduces the space available within the casing for the hammer. This reduced size of the hammer directly results in less impact being delivered against the anvil by the hammer during operation. Loss of impact occurs partly because the hammer is lighter than it would be if it had a greater cross-sectional area; but more importantly, because the reduced space available for the hammer reduces the upper surface area of the hammer available for generating force by means of pressure from the pressurized fluid.

The feeder element merely transfers the pressurized fluid to the proper cavities above and below the hammer. It is the hammer which is the real working element of the drilling impact tool. Thus, due to the reduced space available for the hammer, the device disclosed in the incorporated reference is less efficient than the device as described herein, which provides a hammer with a greater cross-sectional area.

Further, the method of retaining the anvil in U.S. Pat. No. 3,964,551 is awkward in many respects. Five separate components—two retainer ring halves, an O-ring, a lower sub, and an anvil guide—are used to retain the anvil. There is a need to simplify the drilling tool at this point both because the many separate small parts complicate servicing the drilling tool, and because the violent jarring of the anvil may cause such delicate parts to wear and eventually to fail under downhole conditions. Also, due to the limited extension of the lower sub within the casing, requiring the use of a separate part (the anvil guide ring) to position the top of the anvil, this design does not allow the anvil and its mating parts to develop either strength or alignment to the fullest.

SUMMARY OF THE INVENTION

A hammer is slidably located about a central feeder element, both of which are retained within a casing. Due to pressure created by a pressurized fluid below the hammer, the hammer is pushed upward. Thereafter, due to pressure created by a pressurized fluid above the hammer, the hammer is pushed downward so that the hammer strikes an anvil. Since the anvil is attached to a drill bit, the reciprocating motion of the hammer provides for repeated sharp blows by the drill bit against the medium being drilled. The pressurized fluid alternately utilized below and then above the hammer is conducted through or around the feeder element and through hammer passages to the respective cavities above and below the hammer. The feeder element contains only one central flow passage, with a single level of openings in its side wall. Thus, even though it has a significantly reduced cross-section with respect to the referenced patent, its capacity to deliver pressurized fluid is greater.

Control of the flow of pressurized fluid to the upper and lower hammer actuating areas is provided by slidable valve means consisting of the single feeder sideport passage and hammer passages which, due to the slidable relationship of the feeder element and the hammer, are opened and closed by the reciprocation of the hammer. Exhaust of pressurized fluid from above the hammer is also controlled by slide-valve action of the feeder, exhaust from the hammer passage occuring entirely below the lowermost end of the feeder.

The presently disclosed invention utilizes a feeder element which is shorter, narrower, simpler and sturdier than prior feeder elements. As a result, stress effects upon the feeder element are less severe, more room for the hammer is provided, the expense of manufacturing the device is lessened, and down hole failure minimized.

The present invention also offers a unique method of joining the anvil, a lower sub, and the casing in a combination such that the elements cooperate to provide maximum structural support for each other.

It is an object of the present invention to provide a pneumatically actuated impact tool for rotary drilling that provides the maximum space possible for a hammer contained therein.

It is another object of the present invention to provide the maximum upper cross-sectional area for the hammer in order to allow for the greatest possible force to be generated by the pressurized fluid against the hammer element.

It is yet another object of the present invention to provide a pneumatically actuated tool at a minimum expense of production due to utilizing fewer and simpler parts, which parts may be manufactured within greater tolerance limits than previous designs have allowed.

It is yet another object of the present invention to provide a pneumatically actuated tool which is structurally designed to endure for a maximum period of time under downhole working conditions.

It is yet another object of the present invention to provide the maximum impact upon a drill bit with a maximum frequency of such impacts.

It is yet another object of the present invention to provide a pneumatically actuated tool which may be easily serviced and returned quickly to operation.

It is yet another object of the invention to join the anvil to the remainder of the impact drilling tool such that a maximum amount of structural support is provided to the tool.

In the present invention, a shortened and simplified central feeder is combined with a novel arrangement of passages within the hammer element and feeder element to produce all of the above desired results. Further, a novel method of attaching the lower sub to the casing allows for increased durability and easier servicing of the impact tool.

DESCRIPTION OF THE PREFERRED EMBODIMENT

Figure 1A:
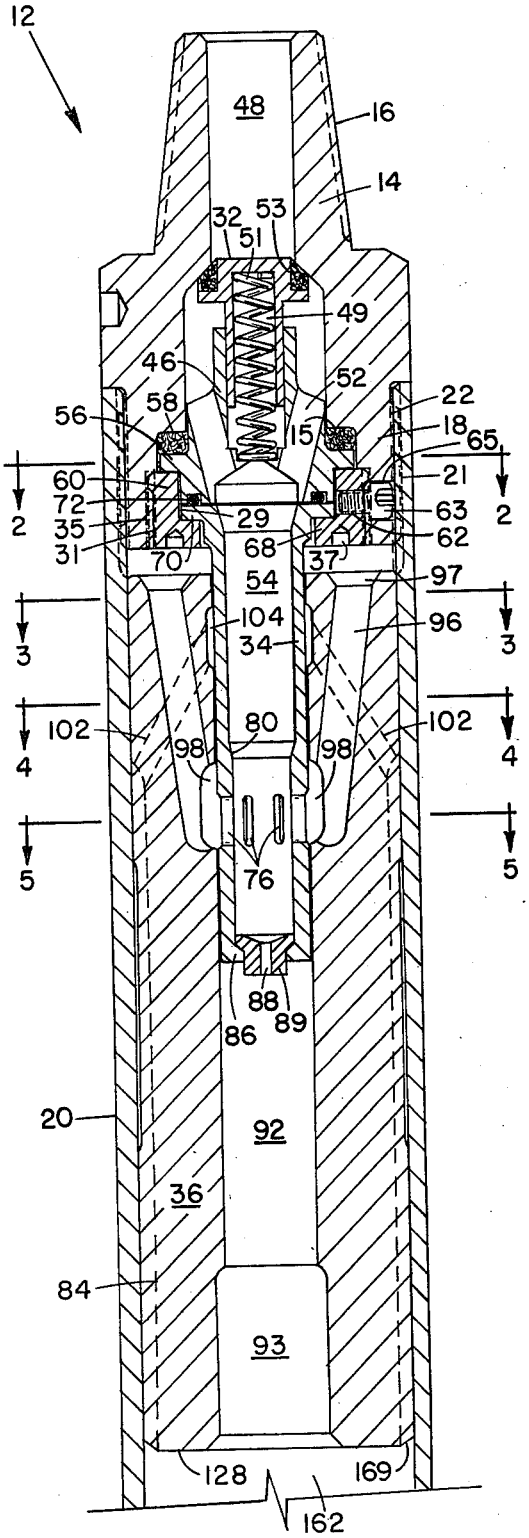
FIG. 1*a* and FIG. 1*b* are elevated sectional views taken along the longitudinal axis of the present invention.
Figure 1B:
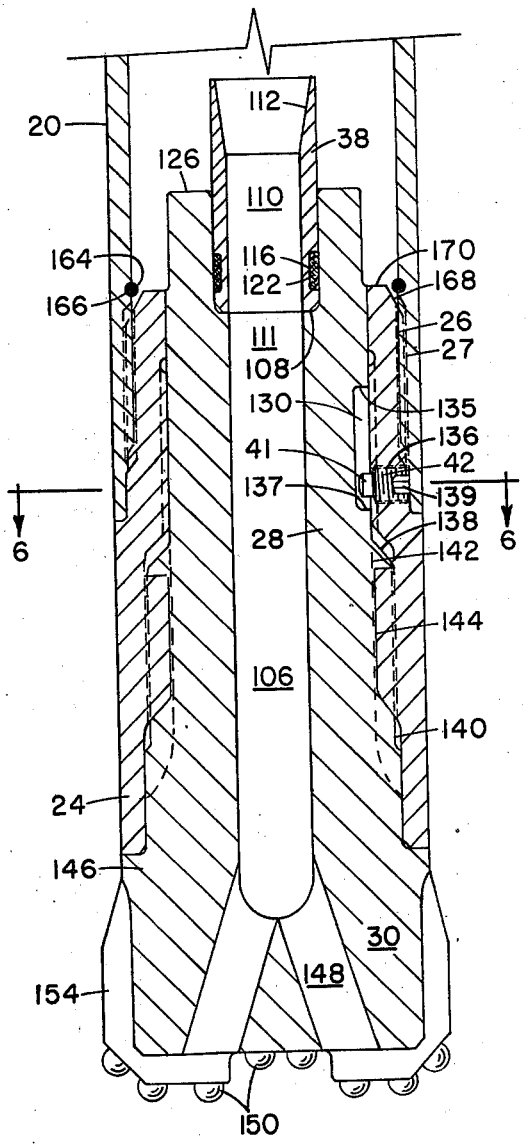
Figure 2:
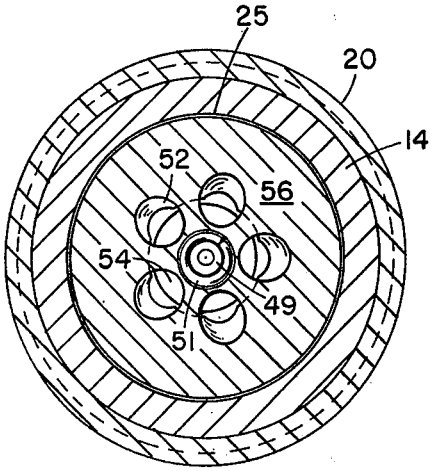
FIG. 2 is a sectional view of FIG. 1*a* taken along section line 2—2.

Referring now to FIGS. 1*a* and 1*b* in combination there is shown an elongated cross-sectional view of the present invention wherein reference numeral 12 represents the pneumatic impact drilling tool. The present invention is designed for connection in a string of drill pipe immediately above a drill bit. The pneumatic impact drilling tool 12 has an upper sub 14 that is connected by means of upper threads 16 to the drill pipe (not shown). To the lower portion 18 of the upper sub 14 threadably engages a casing 20 by means of lower threads 22 of the upper sub 14 and upper threads 21 of the casing 20. The internal portion of the casing 20 which incorporates the present invention will be described in more detail subsequently. The lower portion of the casing 20 connects to a lower sub 24 by means of threads 26 of the lower sub 24 and lower threads 27 of the casing 20. Inside of lower sub 24 is retained an anvil 28 with a drill bit 30 being integrally formed therewith.

It is to be understood that throughout the description of the preferred embodiment that "vertical" shall refer to a direction parallel to the elongated axis of the drilling tool 12 and that "horizontal" shall refer to a direction perpendicular to the elongated axis of the drilling tool 12. It is further understood that "upper" shall refer to the object closest to the drill string and that "lower" shall refer to the object closest to the drill bit 30.

Enclosed within the casing 20 is located a check valve 32 which allows pneumatic fluid to flow from the string of drill pipe, through the impact drilling tool 12, to the drill bit 30, but not vice versa. This prevents cuttings from the drill bit 30 from being drawn into the impact drilling tool 12. Below the check valve 32 is located a feeder element 34 which controls many of the valving functions of the pneumatic impact drilling tool 12. The check valve 32, feeder element 34, and the passages and structures thereof are collectively referred to as "feeder means". Around the feeder element 34 is located an axially slideable hammer 36, which in operation repeatedly strikes the striking surface 126 of the anvil 28. Between the hammer 36 and the anvil 28 is located an exhauster 38 which controls at least one of the exhaust functions of the pneumatic impact drilling tool 12. For assembly purposes, at least one screw 42 retains the anvil 28 within lower sub 24, and at least one screw 63 assists in holding a feeder retainer 60 in upper sub 14.

Before describing a method of operation of the present invention, a detailed description of the structure will be given in the following paragraphs. Pneumatic fluid is communicated through the string of drill pipe to the impact drilling tool 12 where it is further communicated through a large orifice 48 located in the upper sub 14, and through sloping passages 52 located in valve retaining block 46 and into the feeder 34 of the impact drilling tool 12. The check valve 32 is located between the valve retaining block 46 and the large orifice 48 upper sub 14.

The large orifice 48 is restricted by the check valve 32 pressing against the lower surface of the large orifice, which check valve acts to prevent the reverse flow of pneumatic fluid therethrough. The check valve 32 consists of a spring loaded dart 49 with a resilient sealing material 53 (normally rubber) sealing against the base of the large orifice. Inside the dart is a coil spring 51 for urging the dart 49 into the closed position as shown in FIG. 1*a*. The coil spring 51 has a small compression force exerted thereon by the dart 49 and valve retaining block 46. The pressure drop across check valve 32 is normally very small when compared to the working pressure of the fluid flowing through the tool 12.

The valve retaining block 46 is maintained in position by means of valve retaining block flange 56 that is wedged between a makeup ring 58 and feeder retainer 60. The makeup ring 58 is located beneath a first shoulder 15 of upper sub 14, and is formed from an oil resistant elastomer to provide a firm downward force on retaining block 46 against feeder retainer 60 when all said parts are in place. The lower portion of the feeder retainer 60 has an inward shoulder 68, which mates against outward flange 70 of feeder element 34. The outer radius of outward flange 70 of feeder element 34 is somewhat smaller than the inner radius of feeder retainer 60 with horizontal adjustment space 29 allowing the feeder element 34 a degree of lateral flexibility. O-ring seal 72 is located within a lower cavity of the valve retaining block 46 and pressed against the top of outward flange 70 of the feeder element 34 to insure against leakage of pneumatic fluid around the feeder element 34. Due to use of the elastomer makeup ring 58 and the O-ring seal 74 no substantial pressure may be developed below feeder retainer 60 without passing through the center bore 54 of the feeder element 34.

Further, the use in combination of the horizontal adjustment space 29, elastomer makeup ring 58, and O-ring seal 74 provides for the feeder means to harmlessly adjust its position. The flexible seals cushion the inevitable vibration, and also provide a continuous seal against the pressurized fluid.

To assemble the above parts, the feeder retainer 60 is threadably engaged within the upper sub 14 by threads 31 of the feeder retainer 60 and inner threads 35 of the upper sub 14. At least two "spanner-type" sockets 37 are located in the lower surface of the feeder retainer 60. The upper sub 14 also contains at least one upper sub retaining aperture 65 and the feeder retainer 60 contains at least one corresponding feeder retainer threaded aperture 62. A second retaining threaded screw 63 is placed through the upper sub retaining aperture 65 and threadably engages the feeder retainer threaded aperture 62.

Thus in operation, after the feeder retainer 60 has been threadably engaged and "seated" within the upper sub 14, the second retaining screw 63 is threaded into the feeder retainer 60 threaded aperture 62 to prevent the feeder retainer 60 from backing out of its intended position. Further, when the upper sub 14 is subsequently screwed into the upper threads 21 of the casing 20, it is seen that the casing 20 overlaps the second retaining threaded screw 63 and prevents the second retaining threaded screw 63 from backing out of the feeder retainer threaded aperture 62. Because the drill string and impact drilling tool 12 are only rotated in a clockwise direction while the impact drilling tool 12 is in use, the upper sub 14 is also prevented from backing out of the casing 20.

The feeder means additionally consists of a feeder element 34 as shown in FIG. 1*a*. The feeder element 34 basically consists of a hollow tube enclosing a center bore 54 and is located along the elongated central axis of the impact drilling tool 12.

Figure 5:
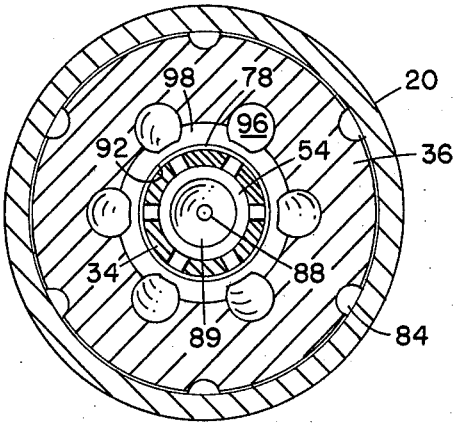
FIG. 5 is a sectional view of FIG. 1*a* taken along section line 5—5.
Figure 3:
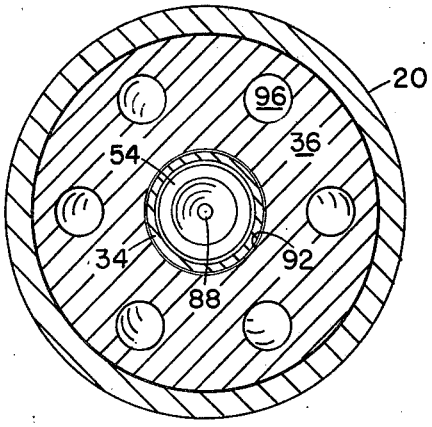
FIG. 3 is a sectional view of FIG. 1*a* taken along section line 3—3.
Figure 6:
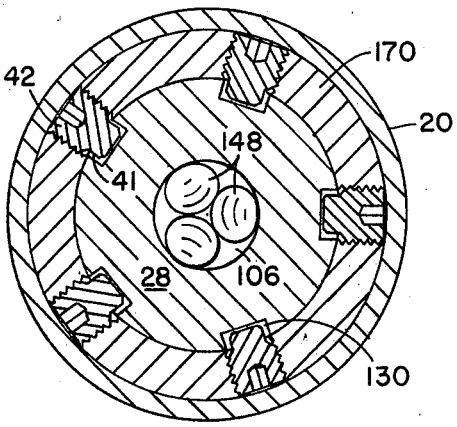
FIG. 6 is a sectional view of FIG. 1*b* taken along section line 6—6.

The first openings from the center bore 54 of the feeder element 34 are cross slots 76 that connect to annulus 78. The annulus 78 is a shallow undercut in the outer surface of feeder element 34. A better understanding of the construction of feeder element 34, cross slots 76 and annulus 78 can be obtained by referring to the cross-sectional view as shown in FIG. 1 and FIG. 5. As shown in FIG. 1*a*, the cross slots 76 are all located at an equal distance from the upper end of the feeder element 34, and all of the cross slots 76 connect the center bore 54 to annulus 78.

The diameter of the center bore 54 of feeder element 34 decreases slightly in the lower section thereof by means of inward slope 80. The outer diameter of the feeder element, however, is approximately constant throughout the entire length of the feeder element 34. At the bottom of the center bore 54 of the feeder element 34 is located a nozzle 89 with a restrictive orifice 88 that will allow a small amount of pneumatic fluid to continually flow through the feeder element 34 and into the center chamber 162 located below. The nozzle 89 is retained within the feeder element 34 by means of shoulder 86, which consists of an inward rim projecting from the inner wall of the feeder element 34 and located at the lower end of the feeder element 34. The restrictive orifice 88 cannot accomodate the high volume of pneumatic fluid (air) that is necessary in rotary drilling operations, and is used mainly to insure that the full capacity of a compressor (not shown) that supplies the air may be utilized. The nozzle 89 may be interchanged with other like nozzles to accomodate different compressor capacities. A second useful feature of the nozzle aperture 88 is that it is positioned to achieve maximum separation of water or other material heavier than air that may enter the tool with the pressurized fluid.

Referring now to the hammer 36, it is basically an elongated annular device that fills the annular space between feeder element 34 and casing 20. The hammer 36 has a center bore 92 that slidably receives the feeder element 34 in a close abutting relationship to form a good metal-to-metal seal therebetween. Oil grooves and oil (not shown) may be used to aid this metal-to-metal seal and also a corresponding metal-to-metal seal with the inner surface of casing 20.

At the top of the hammer 36, hammer openings 97 are connected by slanting bores 96 within the hammer 36 to a first hammer undercut 98 which is located in center bore 92. The location of the slanting bores 96 in the hammer 36 can best be seen in FIGS. 1*a*, 3, 4, and 5. As many slanting bores 96 as are necessary for the proper operation of the impact drilling tool 12 may be utilized.

Figure 4:
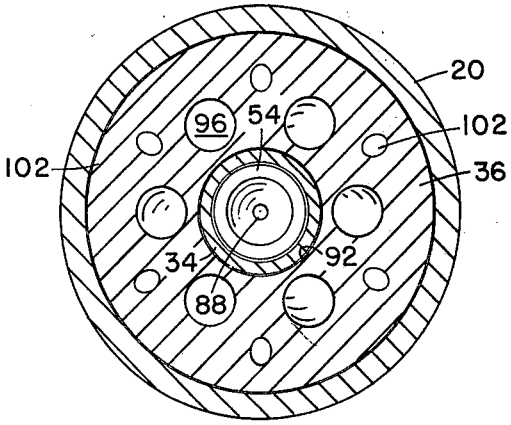
FIG. 4 is a sectional view of FIG. 1*a* taken along section line 4—4.

From the bottom of the hammer 36 along the outside of the hammer 36 in a longitudinal direction, slots 84 are cut parallel to the elongated axis of the hammer 36. These slots 84 form vertical passages between the casing 20 and the hammer 36 and extend approximately two-thirds to three-fourths the length of the hammer 36. The location of the slots 84 may be viewed in FIGS. 1*a*, and 5. Slanting holes 102 intersect the upper portion of the slots 84 and connect the slots 84 to a second hammer undercut 104. The location of the slanting holes 102 may be viewed in FIGS. 1*a* and 4. The second hammer undercut 104 is located in center bore 92 of hammer 36 and is positioned at a point above the first hammer undercut 98. As many slots 84 and slanting holes 102 may be cut as are necessary for the proper functioning of the impact drilling tool 12. FIG. 1*a* shows a full length view of the slanting holes 102 and slots 84 while FIG. 4 shows a radial cross-sectional view of the slanting holes 102.

Within the anvil 28 is located an anvil center bore 106. The anvil center bore 106 consists of a larger diameter upper anvil center bore 110 and a smaller diameter lower anvil center bore 111. Inner anvil shoulder 108 separates the upper anvil center bore 110 from lower anvil center bore 111. Within the upper anvil center bore 110 is located an exhauster 38, which basically consists of an open ended tube and may be formed from any suitable substance, such as plastic or aluminum. The outer diameter of the exhauster 38 is in a close slidable relationship with the lower center cavity 93 of the hammer 36 and forms a slideable seal therewith. An outward tapering of the inner upper surface of the exhauster 112 aids in the dynamic flow of the pneumatic fluid through the exhauster 38. The outer diameter of the exhauster 38 fits snugly inside of the larger upper diameter anvil center bore 110 which is constructed to securely receive the exhauster 38. The outer diameter of the lower portion of the exhauster 38 has an undercut 116 located thereon. The space within the undercut 116 is filled with a resilient material 122. In the preferred embodiment of the present invention, the resilient material 122 is a rubber base substance that is formed on the exhauster 38. Upon assembly of the impact drilling tool 12, the exhauster 38 is pressed into position inside of the anvil 28 with the resilient material holding exhauster 38 in position. The inner diameter of the exhauster 38 is approximately the same as the smaller diameter of lower anvil center bore 110.

Below the striking face 126 of the anvil 28 and on the outer surface of the anvil 28 are located milled pockets 130. The lower sub 24 contains threaded apertures 136 within the lower sub 24 for threadably engaging threaded screws 42. The threaded apertures 136 and screws 42 are appropriately tapered so engagement of the screws within the threaded apertures may be wrench-tight, thereby eliminating all relative vibration between the screws and the lower sub. The threaded screws 42 are spaced radially about the lower sub 24. Each threaded screw 42 projects a rounded end 41 into the anvil 28 milled pockets 130. The threaded screws 42 prevent the anvil from falling out of the lower sub 24 if the tool 12 is picked up off the bottom of the hole being drilled.

When screws 42 are in place within the threaded aperture 136, the outer ends of the retaining threaded screws 42 are either flush with or slightly within the outer surface of the lower sub 24. This slightly recessed or flush position makes it possible to screw the lower sub 24 into position within the casing 20 without the threaded screws 42 blocking such action.

Once in position, the casing 20 prevents the threaded screws 42 from backing out from the threaded apertures 136. This retaining function of the casing 20 is necessary due to the tremendous vibrational forces which occur during operation of the impact drilling tool 12. The sole purpose of the threaded screws 42 is to retain the anvil 28 within the impact drilling tool 12 when the tool is lifted from the bottom of the hole. This will be explained in more detail later, but it should be understood that during operation of the impact drilling tool 12, the lower movement of the anvil 28 will be halted by the bottom of the hole being drilled and that the downward pressure from the drill string upon the tool 12 will be communicated by the lower end of the lower sub 24 abutting outward flange 146 of anvil 28.

The lower sub 24, commonly called a drive sub, is threadably connected to casing 20 by threads 26 of the lower sub 24 threadably engaged with corresponding threads 27 of the casing 20. Therefore, in final alignment, the anvil 28 is firmly held inside of casing 20 by means of the lower sub 24 and retaining screws 42.

Referring now to the lower portion of FIG. 1*b*, it can be seen that anvil 28 and lower sub 24 are assembled into a splined relationship with respect to each other. Grooves 138 of lower sub 24 receive vertical ridges 140 of anvil 28 and vice versa for grooves 142 of anvil 28 and vertical ridges 144 of lower sub 24. It should be realized that the mating of grooves 138 and 142 and vertical ridges 140 and 144, respectively, between anvil 28 and lower sub 24 allows free elongated axial movement but does not allow radial movement between the anvil 28 and the lower sub 24. This splined relationship between the grooves prevents the drill bit 30, which is formed intergral with the anvil 28, from rotating except as turned by casing 20. The upper portion 170 of the lower sub 24, located above the threaded screws 42, provides additional lateral support for the anvil 28.

A snap ring 164 is set within a shallow casing indentation 166 located within the casing and immediately adjacent to the upper end 170 of the lower sub 24, and partially within a lower sub snap ring cut 168. The lower sub snap ring cut 168 is an inward angling of the outer surface of the lower sub 24 about the outer edge of the upper portion 170 of the lower sub 24. This is done in such a manner that upon final installation, the uppermost portion of the lower sub 24 is in an approximately equal vertical position as is the snap ring 164 but, due to the lower sub snap ring cut 168, does not contact the snap ring 164. Further, a hammer snap ring cut 169 is located upon the lower outer surface and bottom surface of the hammer 36 in a manner corresponding to that of the lower sub 24 snap ring cut. The hammer 36 snap ring cut 169 is an inward angling of the outer surface of the hammer 36 about the outer edge of the lower end of the hammer 36. When the impact drilling tool 12 is lifted from the bottom of the hole being drilled, the drill bit 30 and anvil 28 are no longer supported by the bottom of the hole. The anvil 28 will drop through the lower sub 14 until the upper end 135 of the anvil undercut 130 abuts the threaded bolts 42. The dropping of anvil 28 removes the anvil 28 as a support for the hammer 36. The hammer 36 also drops down until it is halted by the upper end of the lower sub 24. At this point, the snap ring 164 is non-functional, being contained within the space formed by the concurrence of the hammer snap ring cut 169 and the lower sub snap ring cut 168.

When the hammer 36 follows the anvil 28 as the impact drilling tool 12 is raised from the bottom of the hole, the top of the hammer 36 slides below the cross slots 76 of the feeder element 34. Therefore, the flow of pneumatic fluid is directed through the cross slots 76 of the feeder element 34, across the top of the hammer 36, into the hammer opening 97 located upon the upper surface of the hammer, through the downward slanting bore 96 of the hammer, the center bore 92, exhauster 38 and thence out through the drill bit 30. This allows for continued circulation of pneumatic fluid through the impact drilling tool 12 without damaging the impact drilling tool 12 when it is lifted from the bottom of the hole. This is necessary in order to clean the hole of cuttings prior to pulling the impact drilling tool 12 from the hole.

The functionality of the snap ring 164 occurs when the impact drilling tool has been completely pulled from the hole. At this point, it is often necessary to replace the old worn bit 30 with a new bit. Because the bit 30 is formed integrally upon the anvil 28, the anvil 28 and lower sub 24 are removed in order to replace the bit. When this entire lower portion of the impact drilling tool 12 is removed, the lower sub 24 no longer serves to support the hammer 36. At this point, the snap ring 164 becomes functional as the hammer 36 slides down and is halted by the snap ring 164 from sliding from the casing 20 of impact drilling tool 12.

The advantages of the above type of structure over previously patented structures are numerous. The present invention allows the worn drill bit to be quickly exchanged for a new drill bit simply by unscrewing and removing the old lower sub 28 containing the worn drill bit 30, and replacing it with a new lower sub 28 containing a new drill bit 30. Thus, an exchange of bits is made possible without the necessity of completely disassembling the impact drilling tool 12. The presence of the snap ring 164 as located and the threaded screws 42 as located are each necessary to prevent the hammer 36 and anvil 28, respectively, from sliding out of the impact drilling tool. Bits will be resharpened for reuse in the tool without disassembly from lower sub 28. However, when an anvil-bit is completely worn out, screws 42 may be removed and the lower sub remated to a different anvil. The fact that a single structural unit (the lower sub 24) is utilized to support and guide the anvil 28, engage the casing 20, retain the hammer and provide hold-down pressure upon the drill bit 30, rather than employing a plurality of structures to perform those functions, enables the present impact drilling tool 12 to be considerably more durable than current drilling tools and to be more economically manufactured.

When drilling, the lower portion of the lower sub 24 abuts against an outward flange 146 of the anvil 28 to force the anvil 28 and drill bit 30 downward. As the anvil 28 center bore 106 approaches the lower end of the anvil 28, the anvil 28 center bore 106 converts into slanting passages 148 that communicate the pressurized fluid through the drill bit 30. A cutter portion composed of specially hardened inserts 150, is formed on to the lower end of the drill bit 30. The hardened inserts 150 are located about its outer edge by an outer support 154. The outer circumference of the outer support 154 of the drill bit 30 and of the hardened inserts 150 is slightly larger than that of the casing 20. This is necessary in order to drill a hole having a larger diameter than the outer diameter of the casing 20 so that exhausted air and drill cuttings may have an open annulus to the surface.

Although the present invention is shown in conjunction with a solid head type of bit, a roller cone type of bit may be utilized by a proper adjustment of the downward impact force.

By combining the various elements of the impact drilling tool 12, as described above, speedy replacement of the anvil 28 and drill bit 30 is facilitated and because this entire portion of the drilling tool 12 (lower sub 24, anvil 28 and drill bit 30) can be removed as a unit, the difficulty, time, and skill involved in removing and replacing these elements when they become worn is greatly reduced. Further, the unit is structurally well adapted to perform under rigorous down hole conditions.

METHOD OF OPERATION

As the pneumatic fluid (air) flows through the large orifice 48, the check valve 32 is subjected to high pressure. This high pressure forces the check valve 32 open and the pneumatic fluid flows through the slanting passages 52 of the valve retaining block 46 and into the center bore 54 of the feeder element 34. At the bottom of the center bore 54 of the feeder element 34, a small amount of the air continually flows through the nozzle 89 of the restrictive orifice 88. The majority of the air, however, flows outward through cross slots 76 of the feeder element 34.

Figure 7:
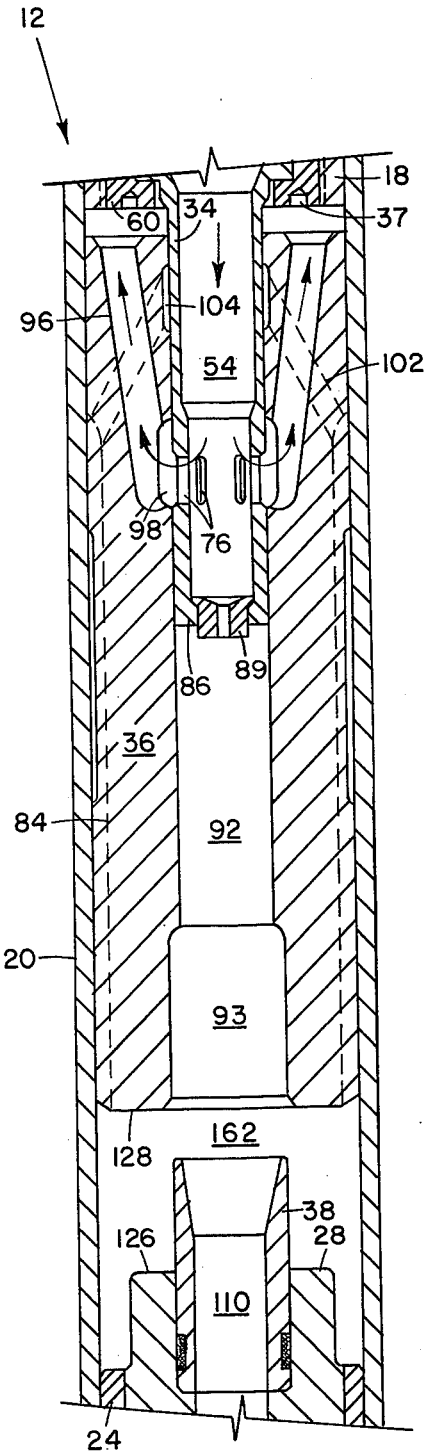
FIGS. 7 and 8 are simplified elevated sectional views showing pictorial illustrations of the different phases of operation of the impact drilling tool.
Figure 8:
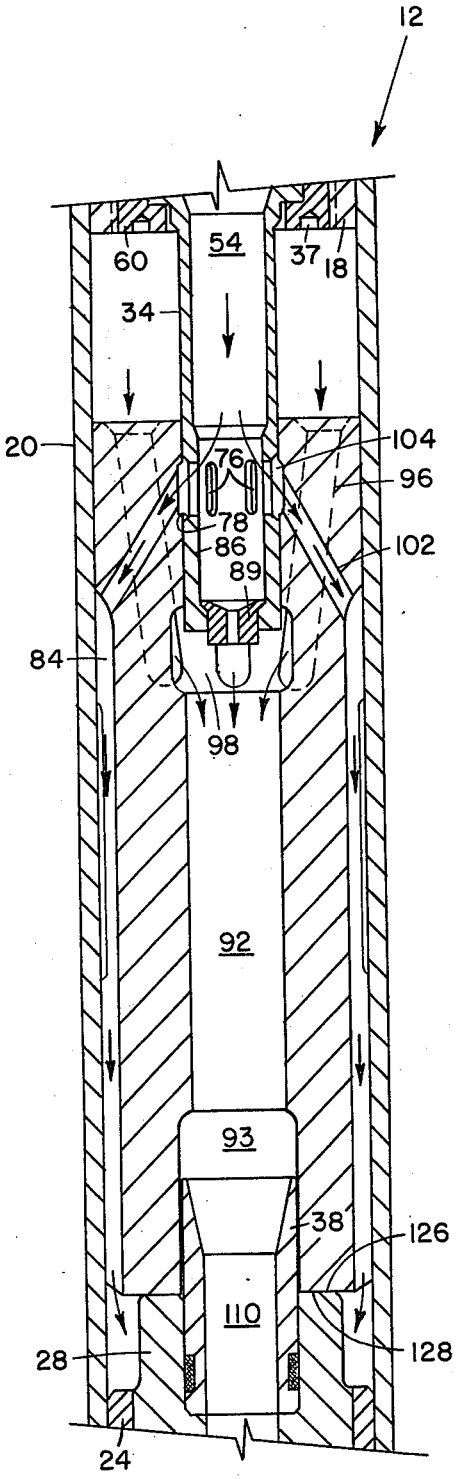

Referring now to FIGS. 7 and 8, there are shown pictorial schematic views of the impact drilling tool 12 to illustrate the sequential positions of the hammer 36 and the air flow through the impact drilling tool 12. Like numbers will be used to designate like parts as previously described in conjunction with FIGS. 1–6.

In FIG. 8, the hammer 36 has just struck the anvil 28. Air flows through the center bore 54 of feeder element 34, cross slots 76 and annulus 78 into the second hammer undercut 104, through the downward slanting holes 102 and connecting slots 84 to below the hammer 36. The pressurized air thus transferred to underneath the hammer 36 creates an upward pressure upon the hammer 36 as it attempts to expand. This upward pressure upon the base of the hammer 36 causes the hammer 36 to begin moving upward.

As the hammer 36 moves upward, the flow of air through the cross bores 76 of the feeder element 34 is terminated as the second hammer undercut 104 of the hammer 36 moves upward and past the uppermost portion of annulus 78 of the feeder element 34. The air trapped between the bottom of the hammer 36, the top of the anvil 28, the outer diameter of the exhauster 38 and the inner surface of the casing 20, continues to expand, however, and continues to force the hammer 36 upward.

Further, the upward momentum of the hammer 36, resulting from the initial burst of highly pressurized air upon the bottom of the hammer 36, as described above, continues to propel the hammer 36 upward. As the hammer 36 is thus being driven upward, the first hammer undercut 98 of the hammer 36 moves into alignment with the annulus 78 of the feeder element 34. A flow relationship is thus created by the highly pressured air in the center bore 54 of the feeder element 34, through the cross slots 76 and annulus 78, into the first hammer undercut 98, through the slanting bores 96, and hammer openings 97 to above the hammer 36.

The continually expanding trapped air from below the hammer 36 and the upward momentum of the hammer 36 maintain the upward movement of the hammer 36 until the downward force of the pressurized air communicated to above the hammer 36 overcomes those upward forces and the upward movement is halted. Also, at a given point in the upward movement of the hammer 36, the bottom of the lower center cavity 93 of the hammer 36 moves above the uppermost portion of the exhauster 38 and releases the pressurized air which had been trapped below the hammer 36. The released air escapes across the top of and through the exhauster 38 and is ultimately ejected through the drill bit 30.

FIG. 7 shows the hammer 36 in its uppermost position. By utilizing an oversized first hammer undercut 98, a large slanting bore 96 and annulus 78 of the feeder element 34, a very rapid pressurization is completed above the hammer 36 when the first hammer undercut 98 moves adjacent to the cross slots 76 of the feeder element 34. The air pressure below the hammer 36 has at this point dissipated across the top of the exhauster 38, into center chamber 162 and through the exhauster 38 because the hammer 36 and exhauster 38 are no longer in a close slidable relationship. The upward momentum of the hammer 36 has been overcome by the highly pressurized air that has suddenly been injected into the space immediately above the hammer 36. This cushion or stop means of highly pressurized air above the hammer 36 prevents the hammer 36 from striking the feeder retainer 60 and upper sub 14. This is necessary in order to prevent the hammer 36 from damaging the upper portion of the impact drilling tool 12.

At the position shown in FIG. 7, the hammer 36 is, for an instant motionless. Highly pressurized air above the hammer 36 exerts a large downward force upon the hammer 36. Due to the force of the pressurized air above the hammer 36 and the lack of resistance below the hammer, the hammer begins to accelerate very rapidly as it moves downward. Furthermore, due to the large mass of the hammer 36, a large momentum is thus attained.

The flow relationship from the center bore 54 of the feeder element 34 to the space above the hammer 36 is terminated due to the first hammer undercut 98 of the hammer 36 sliding out of communication with the cross bore annulus 78 of the feeder element 34. Further, as the lower end of the first hammer undercut 98 of the hammer 36 moves below the lower end of the feeder element 34, the highly pressurized air trapped above the hammer 36 begins to flow through the slanting bores 96 of the hammer 36 and into the upper center cavity 92 of the hammer 36, thus relieving the hammer 36 of any appreciable air pressure above it. In other words, the lower end of the feeding means in conjunction with the first duct means in the hammer means provides a second slidable valve means for exhaust above the hammer means to the center chamber.

Thus, after the hammer 36 is stopped in its upward motion and begins its downward motion by highly pressurized air above the hammer 36, the highly pressurized air above the hammer 36 is dissipated through the upper center cavity 92 of the hammer 36 and into the center chamber 162. The sliding valve relationship of the first hammer undercut 98 of the hammer 36 with the end of the feeder element 34 permits this dissipation to be effected very rapidly.

Further, as the hammer 36 moves downward, a flow relationship is established between the center bore 54 of the feeder element 34 and the space below the hammer 36 as was previously shown in FIG. 7. This is accomplished when the second hammer undercut 104 of the hammer 36 slidably moves adjacent to the annulus 78 of the feeder element 34. The highly pressurized air is communicated from the center bore 54 of the feeder element 34 through the cross slots 76, annulus 78, the second hammer undercut 104, slanting holes 102, and slots 84 to the space below the lower face of the hammer 36. Thus, immediately prior to the impact of the hammer 36 upon the anvil 28 pressurized air begins to build up in the space below the hammer 36. As the hammer 36 moves downward, the lower center cavity 93 of the hammer 36 engages in a slidable mating relationship with the outer radial surface of the exhauster 38 thus providing a sealed cavity within which the highly pressurized air is trapped below the hammer 36. Because the anvil 28 projects above the top of the lower sub 24, the pressurized air is forced from between the striking hammer 36 and anvil 28 and into the space beneath the hammer 36 and to the outside of the upper portion of the anvil 28. Thus, the pressurized air below the hammer 36 does not prevent a solid striking of the hammer 36 upon the anvil 28 as it had stopped the hammer 36 from striking the feeder retainer 60 and upper sub 14 in the earlier upward portion of the cycle. The impact of the hammer 36 striking the anvil 28 is conducted through the anvil 28 to the drill bit 30 where the work function of the impact drilling tool 12 is performed.

The hammer 36 both bounces upward from the top of the anvil 28 which it has struck and is lifted by the pressurized air which is being conducted to beneath it. The position of the parts of the impact drilling tool 12 are now in place for another cycle as described above and as shown in previously described FIG. 8. Due to the reciprocating nature of the device, FIGS. 7 and 8 are each descriptive of more than one point of the complete cycle. FIG. 7, for example, describes the position of the hammer 36 both as it is ascending and descending.

The downward momentum of the hammer is determined by integrating the force of the highly pressurized air over the hammer 36, less the instantaneous pressure existing below the hammer 36, times the cross-sectional area of hammer 36, throughout its entire stroke length. Effects of friction and gravity and minimal. Use of a single passage center feed (feeder element 34) as described in the present invention, provides a larger surface area against which the pressurized air can act to drive the hammer than when either a multiple passage center feeder or "through-the-casing" feed system is employed. Further, valving and feeding pneumatic fluid to the hammer by means of passages within the casing often entails a substantial weakening of the casing itself. It is clear, therefore, that the large upper and lower surface areas of the hammer 36 provided in the present invention result in maximum forces, accelerations, and repetition rates for a given diameter of hole being drilled.

What is claimed is:

1. An impact drilling tool for connection in a string of drilling pipe, said tool comprising:

an upper sub for connection to said drilling pipe;

a casing with an upper end connected to said upper sub;

anvil means slideably received in a lower end of said casing, said anvil means being connected to bit means;

hammer means carried in said casing above said anvil means, said hammer means reciprocating along an elongated axis of said tool for striking said anvil means during each cycle;

means for feeding pressurized pneumatic fluid from said drilling pipe through a center portion of said hammer means, said feeder means having a lengthwise passage and a set of radial passages, a lower end of said feeder means terminating within said center portion of said hammer means;

cross passages in said hammer means with a first set terminating at an upper end above said hammer means and a second set terminating at a lower end below said hammer means, a lower end of said first set of cross passages terminating in said center portion below an upper end of said second set of cross passages which also terminate in said center portion;

said set of radial passages slideably connecting with said lower end of said first set of cross passages and said upper end of said second set of cross passages to respectively pressurize above and below said hammer means during each cycle thereof, said lower end of said feeder means slideably connecting with said lower end of said first set of cross passages to exhaust pressure above said hammer means during each cycle thereof;

exhaust means carried by said anvil means and located between said hammer means and said anvil means for exhausting pressure below said hammer means during each cycle thereof.

2. The impact drilling tool for connection in a string of drilling pipe as given in claim 1 wherein said feeder means includes a first annulus thereon connecting said radial passages, said hammer means having a first undercut therein connecting said lower end of said first set of cross passages and a second undercut therein connecting said upper end of said second set of cross passages, said first annulus slideably connecting to said first undercut and said second undercut, respectively.

3. The impact drilling tool for connection in a string of drilling pipe as given in claim 2 wherein said first and second sets of said cross passages include slanting bores through said hammer means, said second set of slanting bores connecting to downwardly extending slots in an outer perimeter of said hammer means, said slots terminating at a lower end below said hammer means.

4. The impact drilling tool for connection in a string of drilling pipe as given in claims 2 or 3 wherein said lower end of said feeder means slideably connects with said first undercut to exhaust pressure above said hammer means during each cycle thereof.

* * * * *